US009903084B2

(12) United States Patent
Alford et al.

(10) Patent No.: US 9,903,084 B2
(45) Date of Patent: Feb. 27, 2018

(54) SYSTEM AND METHOD FOR IMPROVING A JACK UP PLATFORM WITH ASYMMETRIC CLEATS

(71) Applicant: Bennett Offshore, Houston, TX (US)

(72) Inventors: Jake Alford, Houston, TX (US); William Bennett, Houston, TX (US)

(73) Assignee: Bennett Offshore, L.L.C., Houston, TX (US)

( * ) Notice: Subject to any disclaimer, the term of this patent is extended or adjusted under 35 U.S.C. 154(b) by 0 days.

(21) Appl. No.: 15/190,515

(22) Filed: Jun. 23, 2016

(65) Prior Publication Data

US 2017/0002534 A1 Jan. 5, 2017

Related U.S. Application Data

(60) Provisional application No. 62/183,370, filed on Jun. 23, 2015.

(51) Int. Cl.
*E02B 17/02* (2006.01)
*E21B 15/02* (2006.01)
*E02B 17/00* (2006.01)

(52) U.S. Cl.
CPC ..... *E02B 17/021* (2013.01); *E21B 15/02* (2013.01); *E02B 2017/006* (2013.01); *E02B 2017/0082* (2013.01)

(58) Field of Classification Search
CPC ..... E02B 17/021; E02B 17/08; E02B 2017/0056; E02B 2017/0073; E02B 2017/0082; E02B 2017/0039; E02B 17/00; E02B 27/525; E02B 15/02
USPC .... 405/195.1, 196, 198, 199, 200, 202, 203, 405/205, 207
See application file for complete search history.

(56) References Cited

U.S. PATENT DOCUMENTS

| | | | | |
|---|---|---|---|---|
| 2,248,051 | A * | 7/1941 | Armstrong | E02B 17/021 114/265 |
| 2,938,354 | A | 5/1960 | Knapp | |
| 3,241,324 | A | 3/1966 | Storm et al. | |
| 3,996,754 | A | 12/1976 | Lowery | |
| 4,265,568 | A | 5/1981 | Herrmann et al. | |
| 5,224,798 | A * | 7/1993 | Thomas | E02B 17/021 405/196 |
| 6,099,207 | A * | 8/2000 | Bennett | E02B 17/021 405/196 |
| 2002/0114668 | A1* | 8/2002 | Legleux | E02B 17/0818 405/3 |
| 2009/0090191 | A1* | 4/2009 | Lenders | E02B 17/0818 73/786 |
| 2010/0150660 | A1* | 6/2010 | Nadarajah | E02B 17/00 405/196 |
| 2011/0129304 | A1* | 6/2011 | Wu | B63B 21/26 405/224 |
| 2013/0315677 | A1* | 11/2013 | Schellstede | B63B 27/30 405/196 |

* cited by examiner

*Primary Examiner* — Carib A Oquendo
(74) *Attorney, Agent, or Firm* — Duane Morris LLP

(57) ABSTRACT

A mobile drilling unit having a floatable platform for use in a body of water with a plurality of vertical support legs. With each vertical support leg configured to move with a cleat at the lower end of each support leg. Each cleat having a lower surface to transmit gravitational force from the unit to the sea floor. The cleats are asymmetric with respect to the legs which allows expansion of the center of pressure on the cleats to be beyond the vertical support legs.

19 Claims, 6 Drawing Sheets

FIG. 2b
Prior Art
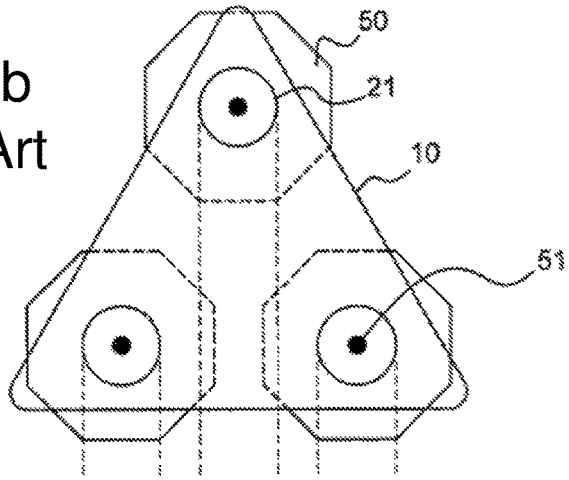
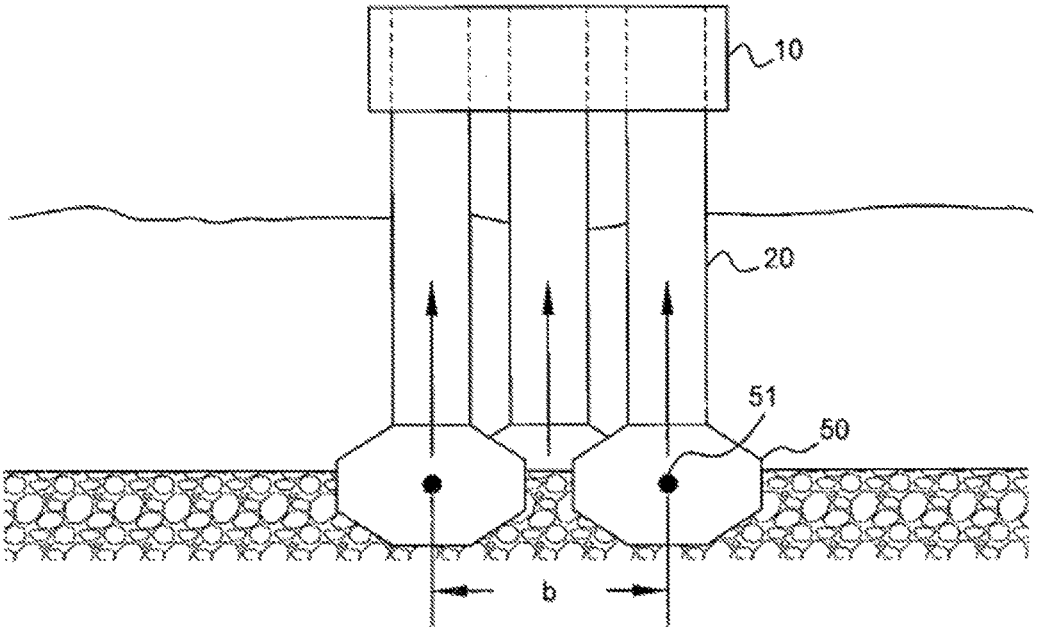
FIG. 2a
Prior Art

SYSTEM AND METHOD FOR IMPROVING A JACK UP PLATFORM WITH ASYMMETRIC CLEATS

RELATED APPLICATIONS

This application is a non-provisional of and claims priority benefit to U.S. provisional application number 62/183,370 filed June 2015 the disclosure of which is incorporated herein by reference.

BACKGROUND

Generally, an offshore jacket is comprised of at least three substantially vertical legs that are interconnected by framing or cross-bracing members to form a triangular or rectangular base, wherein a leg is disposed at each corner of the base. In its upright position, the jacket rest on the sea floor with the bottom of the legs resting on the sea floor or slightly penetrating into the soil. The jacket is secured to the sea floor with piles which are either driven through the legs or driven through sleeves attached to the legs. FIG. 1 shows a traditional offshore jacket. The flared jacket 25 provides wider base (b) for greater stability when attached to the sea floor.

In many areas of the world, the soil of the sea floor is unconsolidated and very soft resulting in very low allowable bearing pressures. These soft sea floors occur frequently near the mouths of large rivers that empty into the oceans. Sea beds in the world which exhibit high hydrocarbon content but are characterized by soft soils from river deltas include areas in the Gulf of Mexico, west Africa and southeast Asia.

The low bearing pressures of these unconsolidated sea floors create jacket support problems during installation of offshore platforms. Specifically, without adequate support, the legs of a jacket will sink into the sea floor, causing the jacket to either fall onto its side or settle lower than design specifications. In any case, jacket settling due to a soft sea floor can negatively affect the alignment of the jacket as it is positioned at the drilling site. In this same vein, difficulties often arise during pile driving operations, which are generally completed within one to two weeks of placing a jacket in position on the sea floor.

One solution to the difficulties associated with unconsolidated sea floors is to provide a structure that spreads the downward forces applied to the jacket over a larger area of the sea floor. The most common structure for accomplishing this task is called a mudmat. A mudmat has a very large surface area that rests against the sea floor (as opposed to the comparatively small surface area of a jacket leg), distributing the load of the jacket over a larger sea floor, thus allowing the jacket to properly stand on the soft sea floor and to provide stability during pile-driving operations. The bearing plate rests against the sea floor and provides the large surface area for force distribution.

There are several different types of units. Of course one of the first developed was the fixed platform in which the legs or supports of the rig are permanently installed, penetrating the floor of the body of water in which the well is to be drilled as discussed previously in FIG. 1. Such a structure is limited by water depth and does not provide the mobility and flexibility of the mobile or portable type unit.

One form of unit is the self-elevating platform, sometimes called "bootstrap" or "jack-up", units which are moved to a use site. These units with a plurality of legs, usually three, are lowered from a floating platform through the water for engaging sea floor The footings (cleats or feet), engage with the sea floor, then the platform is jacked up a sufficient distance above the water surface to get the platform above the wave action. U.S. Pat. Nos. 3,996,754 to Lowery and 4,265,568 to Herrmann et al. are representative of this type. Although such units are highly mobile and stable when in place, they are less stable when floating and when in transit from site to site and are limited to a range of water depth while the unit is afloat. In areas of extreme weather conditions, the three or more legs of such rigs may not have the required stability as the base (b) is limited by the size of the platform. This example is shown in FIG. 2. FIG. 2 shows platform 10 supported by three legs 20, connected to cleats or feet 50 on the sea floor 1. The cleats or feet 50 are symmetric with respect to the legs such that the center of pressure 51 exerted by the sea floor 1 is congruent with the center of the legs 20. While those cleats or feet 50 are shown as octagonal, many other symmetric shapes are commonly used, circles, squares, rectangles, ovals, etc. However, each shape is symmetric with respect to the leg to ensure the center of pressure is under the leg, and external bending moments on the legs 20 are minimized.

The present subject matter provides the mobility, low cost and stability in a self-elevating type unit by extending the base beyond the traditional limits of self-elevating platforms, enabling compact transportation and a distributing leg reactions over a larger base (b') on the sea floor.

These and many other advantages of the present subject matter will be readily apparent to one skilled in the art to which the invention pertains from a perusal of the claims, the appended drawings, and the following detailed description of preferred embodiments.

BRIEF DESCRIPTION OF THE DRAWINGS

FIG. 2 is an illustration of a prior art self-elevating platform.

DETAILED DESCRIPTION

Figure 1:
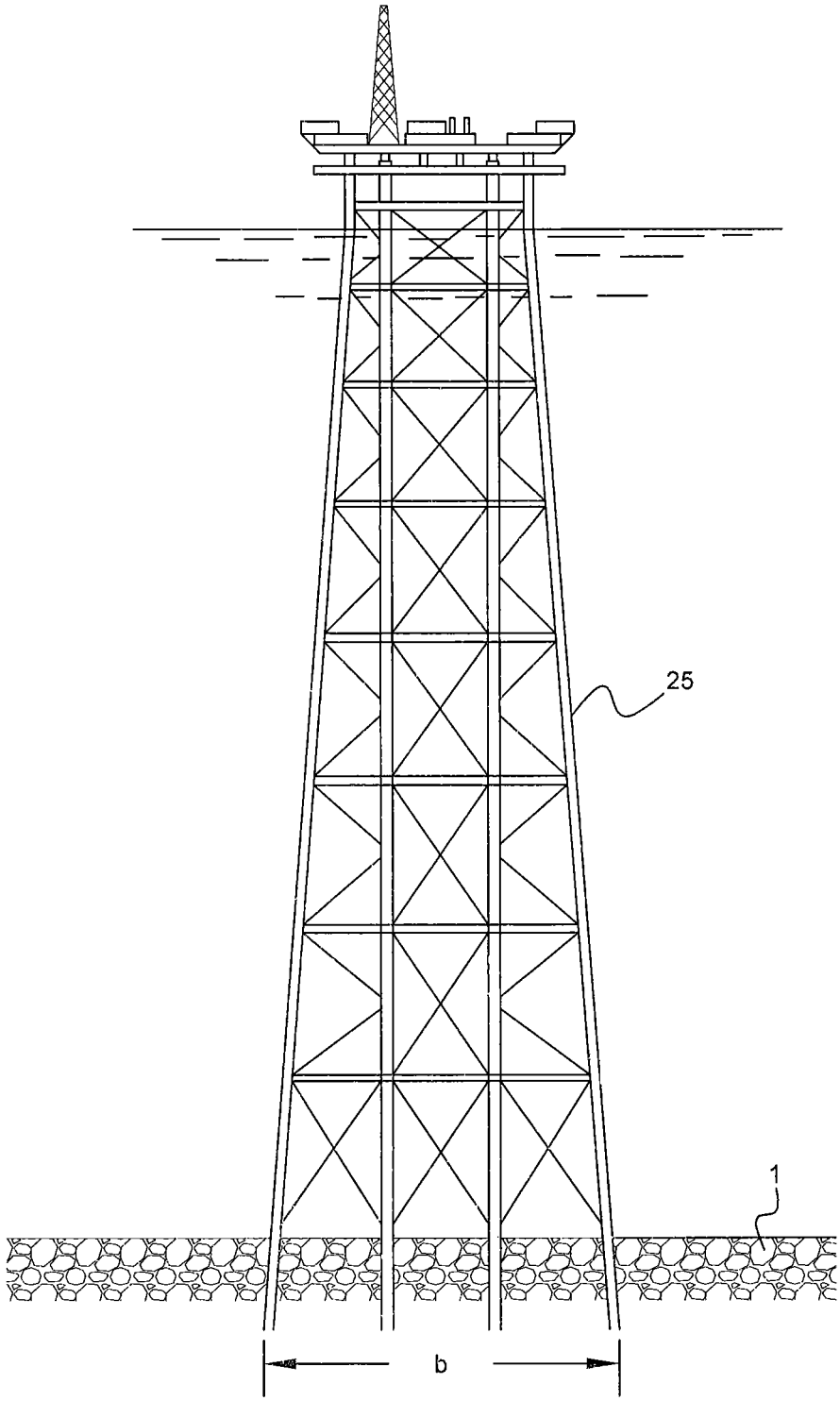
FIG. 1 Prior Art
FIG. 1 is an illustration of a prior art jacket.
Figure 3B:
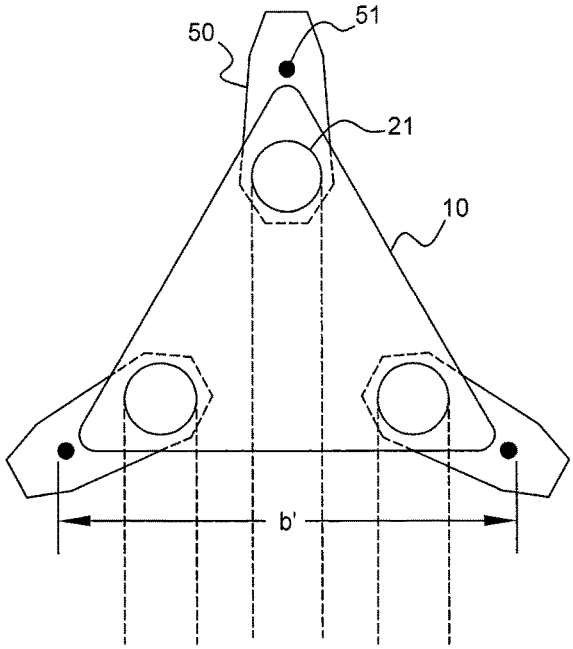
FIGS. 3*a-b* are is an illustration of an embodiment of the disclosed subject matter.
Figure 3A:
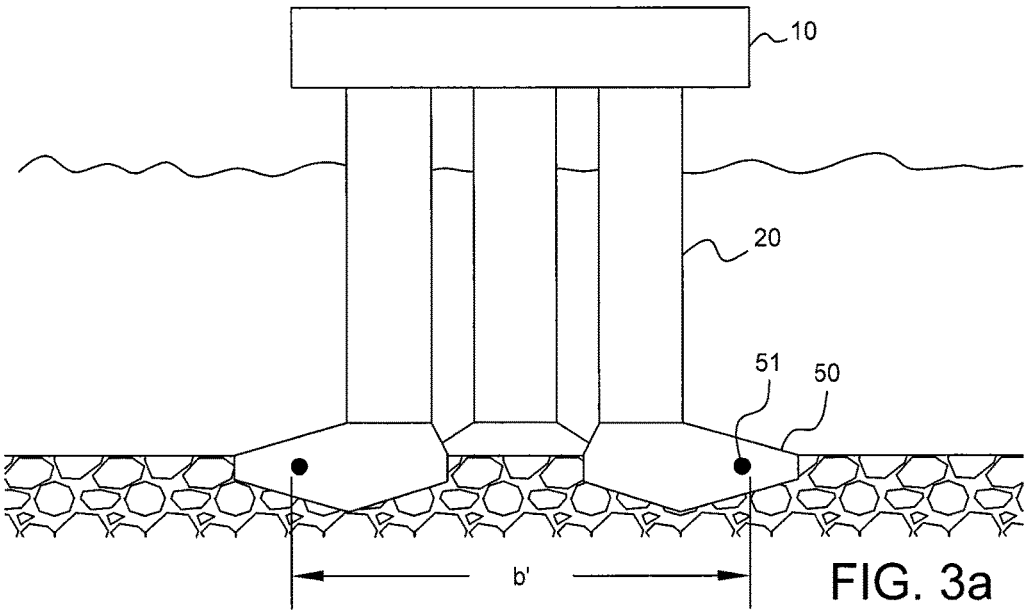

The self-elevating unit of the present subject matter combines desirable features of (fixed) jackets and jack-up units. The self-elevating unit is made up of three major components as shown in FIG. 3: a plurality of legs 20, a respective plurality of cleats or feet 50 and a floatable platform 10. The plurality of legs 20 are each attached to their respective cleat/foot 50 and extend upwardly through a respective leg well 21 provided therefore in the platform 10. The platform 10 supports a drilling derrick, living quarters and other equipment necessary for drilling.

The cleats or feet 50 which preferably provide additional buoyancy for supporting the unit while it is floating and is in transit from site to site. Should it be desired to increase the stability of the unit during transit, say for heavy seas, the cleats or feet may be partially filled with water and lowered to a partially submerged position, lowering the center of gravity of the unit and increasing its stability.

The cleats or feet 50 of the disclosed subject matter differ from that of the prior art in that they are asymmetric with respect to the legs 20 (e.g. are not centered on the leg). Prior art cleats or feet are centered on the leg 20 as such to align the center of pressure 51 under each respective leg. FIG. 2 shows the force provided by the cleat or foot 50 being directed vertically up the leg 20. The center of pressure as used in this disclosure being predominately a function of cleat or foot bottom surface in contact with the sea floor. The cleats or feet as shown in FIG. 3, are configured to have a center of pressure outboard of the leg well 21 and the leg 20, such that a base b' is greater than the base b of the prior art. The bearing force is also directed though the leg 20 to the platform but additionally introduces a moment component as shown in FIG. 3. The larger base b' provides stability.

Figure 4B:
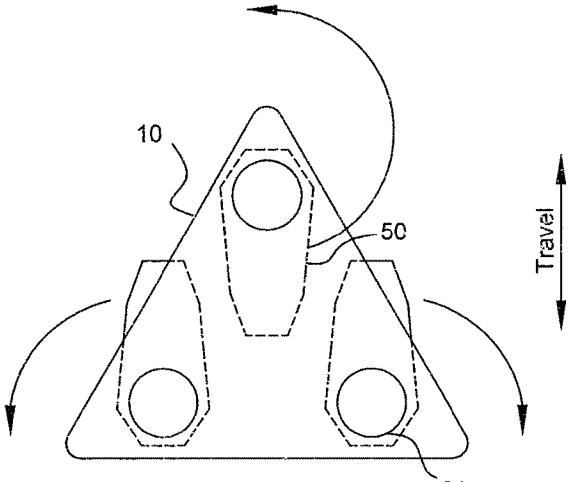
FIGS. 4*a-c* are an illustrations of an embodiment of the disclosed subject matter with the cleats or feet retracted.
Figure 4A:
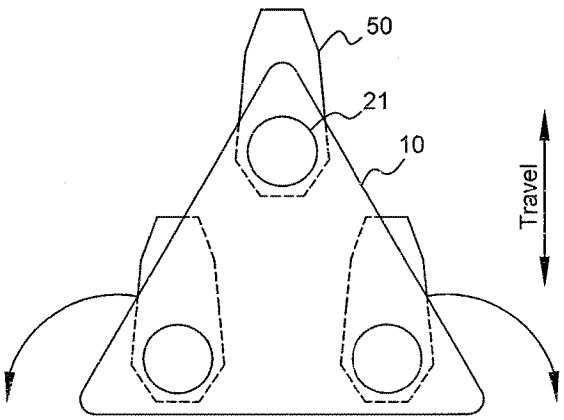
Figure 4C:
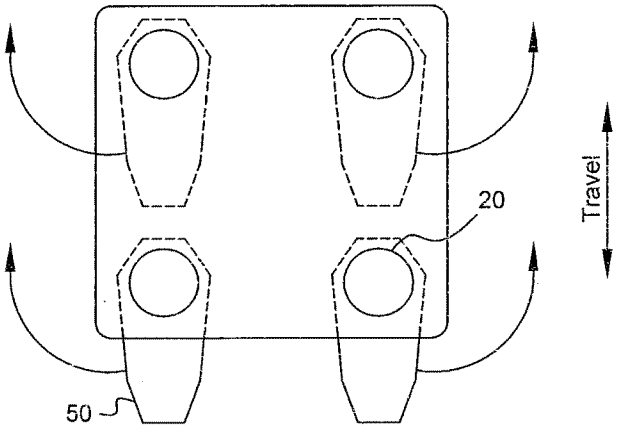

In the initial or transit position, enough ballast is removed from the cleats or feet so that the platform is floating, and the combined buoyancy is supporting the remainder of the unit. In this position, the unit may be moved. The unit may be attached to an ocean going tow vessel for transit to a preselected site. Alternatively, the rig may be positioned on a traditional barge, however this is not preferred. Should heavy seas be encountered during transit, ballast may be introduced into the cleats or feet, at least partially submerging the platform. In this position, the center of gravity is lowered, increasing the stability of the unit . When these adverse conditions have subsided, the ballast may be removed and the platform returned to the above-described floating or transit position. FIGS. 4*a-c* shows another advantage of the present disclosure. The initial or transit portion of the cleats or feet 20 may be rotated to reduce overall size or align with the direction of transport to reduce drag. The rotation may be a function of the elevating jacks, in which the legs 20 are rotated, or may be a function of a rotation system that rotates the cleats or feet 50 relative to the leg 20. FIGS. 4*a-c* show a configuration in which all of the legs are rotated under the platform, are rotated with respect to the direction of travel and shown in a square platform configuration oriented with respect to the direction of travel. FIG. 4*b* in which the cleats or feet 50 are within the bounds of the platform 10 is the minimum size configuration, but also is aligned with the direction of travel.

Upon reaching the selected site, the cleats or feet 50 may be oriented to their operational positions when fully submerged until it and the support legs are fully supported on the floor of the body of water. In the initial stages of this movement, the platform moves upwardly to assume the partially floating position. The relative movement of the legs 20 is permitted by the elevating jacks being engaged to drive the legs 20. At this point, with the feet 50 in contact with the sea floor, the platform which is now floating on the surface of the body of water may be elevated, by means of elevating mechanisms, to a selected height above the surface of the body of water. Then the unit is capable of drilling. If desired, the elevating mechanisms may be removed after drilling has been completed and the entire unit converted to a permanent or semi-permanent platform. However, if it is desired to move the unit to a different location, it is only necessary to move the derrick to its non-interfering initial position, lower the platform until it is floating in the water, and raise the cleats or feet and legs. Then the unit may be moved to another site.

The self-elevating unit of the present invention offers the advantages of traditional and jack-up rigs without some of the disadvantages inherent in each of these designs. Further objects and advantages of the invention will become apparent from the description which follows in conjunction with the accompanying drawings.

Figure 5:
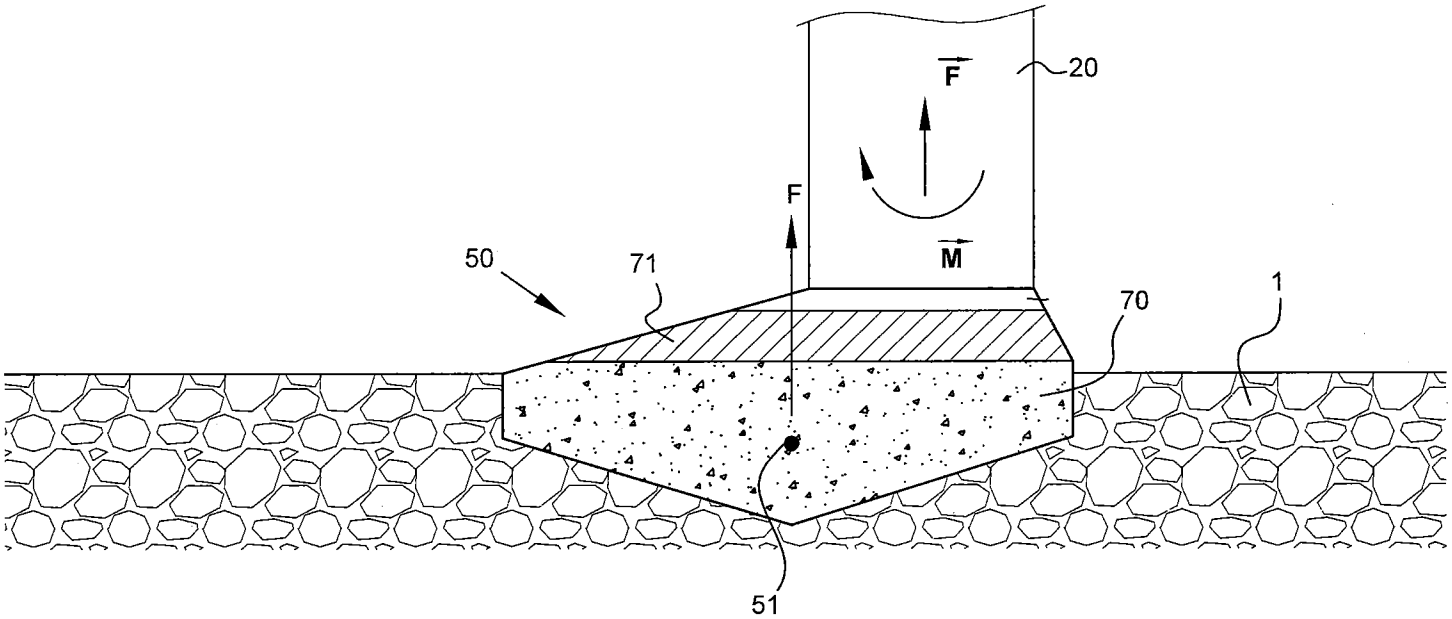
FIG. 5 is an illustration of a cleat or foot according to an embodiment of the disclosed subject matter including ballast and storage.

FIG. 5 also shows the cleat or foot 50 providing a force $\rightarrow_F$ and moment $\rightarrow_M$ to the leg 20, resultant from center of pressure 51 of the cleat or foot 50. The portion of the cleat or foot 50 engaging the sea floor is shown as symmetric in FIG. 5, such that during bottoming of the cleat or foot, a lateral force is not imparted to the leg 20.

Figure 6A:
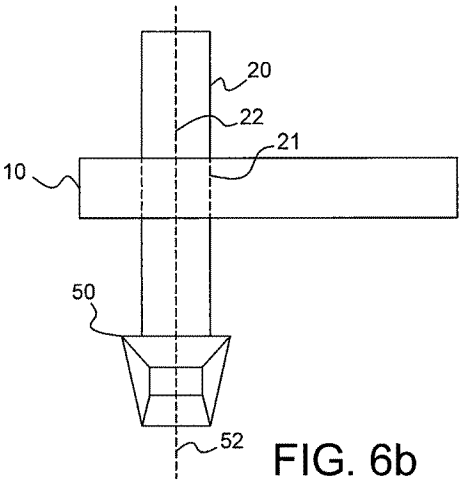
FIGS. 6*a-d* is an illustration of a parallel and oblique rotation of the cleat or foot.
Figure 6B:
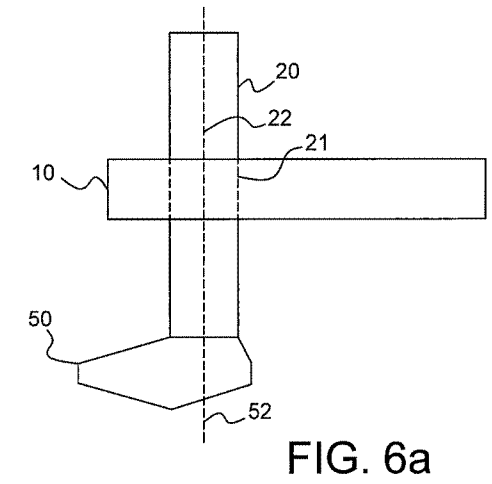
Figure 6C:
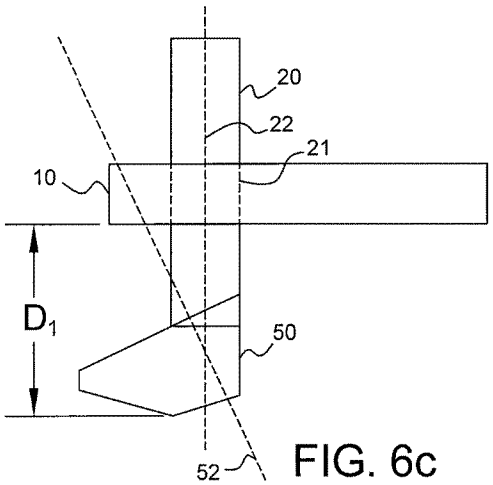
Figure 6D:
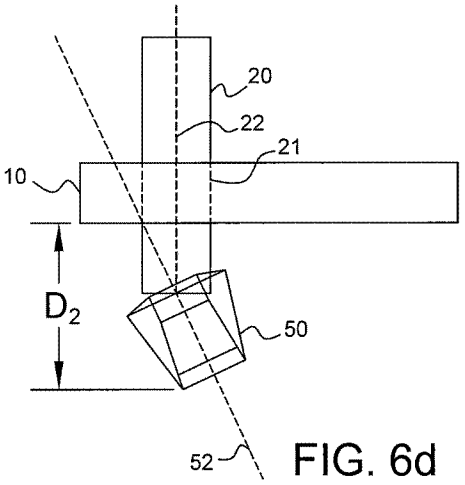

Another aspect of the disclosed subject matter is the ability and advantages of rotating the cleats of feet 50 on an axis oblique 52 to the center axis 22 of the legs 20. As shown in FIGS. 6*a* and 6*b*, the cleat or foot 50 may be rotated about the center axis 22 of the leg 20, such that the depth of the cleat or foot to the platform remains substantially constant. However, as shown in FIGS. 6*c* and 6*d*, if the axis of rotation 52 is oblique to the vertical center axis 22 of the leg 20, a vertical change in the distance between the platform 10 and the cleat 50 may also be accomplished. As shown D1>D2, where the axis of rotation to inclined away from the platform, such a change may advantageously lower the center of gravity during transport and provide greater stability without increasing drag. Moreover, the lower surface of the cleat or foot 50 may be optimized for contact with the sea floor, while the surface presented to the sea in the oblique rotation may be optimized to reduce drag and increase stability, tracking during transport.

As can be seen from the foregoing description and accompanying drawings the self-elevating unit of the present invention offers a low center of gravity for ocean tow with a high degree of ocean tow stability at much less cost than self-elevating units designed for comparable water depths. By having asymmetric cleats or feet, the disclosed subject matter provides the support and greater in-place stability afforded by bottom resting units .

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

The invention claimed is:

1. A self-elevating unit for use in a body of water comprising:

a floatable structure having a plurality of leg wells with jacking systems around a periphery of the structure;

a plurality of vertical support legs, each extending vertically upwardly through a respective one of said plurality of leg wells, each support leg having a respective central longitudinal axis; said vertical support legs being configured to move vertically with respect to the structure from a first retracted position to a second extended position;

each of the vertical support legs including a respective foot attached at a lower end of the support leg, said foot comprising an enclosure for transmitting forces from the self-elevating unit to a sea floor; said foot having a lower surface with a V shape at a bottom-most edge of said lower surface; said foot extending outward from the respective leg, such that the bottom-most edge of said lower surface of said foot is horizontally offset outboard of the central longitudinal axis of the respective leg to which said foot is attached.

2. The self-elevating unit of claim 1, wherein the center of pressure of each foot lies further from a center of the structure than a center of the respective leg to which the foot is connected.

3. The self-elevating unit of claim 1, further comprising leg jacks, capable of moving the vertical support legs from the first retracted position to the second extended position and vice versa.

4. The self-elevating unit of claim 1, wherein the feet add buoyancy to float the drilling unit while in the first retracted position.

5. The self-elevating unit of claim 1 wherein each foot is symmetric about a first plane; said first plane containing a center axis of the respective vertical support leg to which that foot is attached.

6. The self-elevating unit of claim 1, wherein each foot comprises a center and a first end attached to the respective vertical support leg, wherein the first end is laterally distanced from the center.

7. The self-elevating unit of claim 1, further comprising a plurality of foot articulators, capable of rotating the respective feet from the first retracted position to the second extended position and vice versa.

8. A self-elevating unit with two foot configurations for use in a body of water comprising:

a floatable structure having a plurality of leg wells with jacking systems around a periphery of the structure;

a plurality of vertical support legs, each extending vertically upwardly through a respective one of said plurality of leg wells, each support leg having a respective central longitudinal axis, said vertical support legs being configured to move vertically with respect to the structure from a first retracted position to a second extended position;

each of the vertical support legs including a respective foot attached at a lower end of the support leg, said foot comprising an enclosure for transmitting forces from the self-elevating unit to a sea floor; said foot having a center of pressure;

wherein, said foot is configured to extend outward from the respective leg in said second extended position such that the center of pressure of said foot is horizontally offset outboard of the respective leg to which said foot is attached, said foot having a lower surface with a V shape at a bottom-most edge of said lower surface, said foot extending outward from the respective leg, such that the bottom-most edge of said lower surface of said foot is horizontally offset outboard of the central longitudinal axis of the respective leg to which said foot is attached.

9. The self-elevating unit of claim 8, wherein the foot is rotatable about an axis of a respective vertical support leg.

10. The self-elevating unit of claim 9, wherein each foot is rigidly attached to a respective vertical support leg and the vertical support leg rotates about its axis.

11. The self-elevating unit of claim 8, wherein the foot is rotatable about an axis oblique to an axis of the vertical support leg.

12. The self-elevating unit of claim 11, wherein the oblique rotation axis is inclined away from the structure.

13. The self-elevating unit of claim 11, wherein the oblique rotation axis inclines towards the structure.

14. The self-elevating unit of claim 8, wherein the center of pressure of at least one of the feet is inboard of a central axis of the leg to which the at least one of the feet is attached in the first retracted position.

15. The self-elevating unit of claim 8, wherein the center of pressure of each respective foot lies outboard of a vertical centerline of a respective leg thereof or a perimeter of the structure in the second extended position.

16. A method of comprising the steps of:

providing a structure having a plurality of leg wells around a periphery of the structure, said plurality of leg wells each having a center;

providing a plurality of vertical support legs, each support leg located in a respective one of said plurality of leg wells; each of the vertical support legs including a foot attached at a lower end of the support leg, said vertical support legs in a retracted position;

moving the structure to an offshore location;

engaging the feet with a floor of a sea containing water to support the structure;

jacking up the structure to a position above a surface of the water;

wherein each foot is configured for transmitting forces from the structure to the sea floor; said foot having a center of pressure; said foot extending outward from the respective leg such that the center of pressure lies outboard of the respective leg, so as to distribute the forces across the foot, wherein said foot has a lower surface with a V shape at a bottom-most edge of said lower surface, said foot extending outward from the respective leg, such that the bottom-most edge of said lower surface of said foot is horizontally offset outboard of the central longitudinal axis of the respective leg to which said foot is attached.

17. The method of claim 16, further comprising rotating the feet outwards prior to engaging the sea floor, about an axis of rotation parallel with a center axis of the vertical support legs.

18. The method of claim 16, further comprising rotating the feet outwards prior to engaging the sea floor, about an axis of rotation oblique with a center axis of the vertical support legs.

19. The method of claim 18, wherein the foot presents a different surface to the water in the outward rotated position than the surface presented to the water in the non-rotated position.

* * * * *